US009661419B2

(12) United States Patent
Harms et al.

(10) Patent No.: US 9,661,419 B2
(45) Date of Patent: May 23, 2017

(54) MICROPHONE HAVING A MICROPHONE CAPSULE, DYNAMIC SOUND TRANSDUCER FOR HEADPHONES, EARPHONES OR HEADSETS AND METHOD FOR PRODUCING A MICROPHONE CAPSULE OR A SOUND TRANSDUCER

(71) Applicant: Sennheiser electronic GmbH & Co. KG, Wedemark (DE)

(72) Inventors: Alwin Harms, Wedemark (DE); Heinz Epping, Hildesheim (DE); André Michaelis, Wedemark (DE); Günter Pöppel, Stadthagen (DE)

(73) Assignee: Sennheiser electronics GmbH & Co. KG, Wedemark (DE)

( * ) Notice: Subject to any disclaimer, the term of this patent is extended or adjusted under 35 U.S.C. 154(b) by 93 days.

(21) Appl. No.: 14/389,050

(22) PCT Filed: Mar. 26, 2013

(86) PCT No.: PCT/EP2013/056363

§ 371 (c)(1),
(2) Date: Sep. 29, 2014

(87) PCT Pub. No.: WO2013/144122

PCT Pub. Date: Oct. 3, 2013

(65) Prior Publication Data

US 2015/0086058 A1 Mar. 26, 2015

(30) Foreign Application Priority Data

Mar. 30, 2012 (DE) ..... 10 2012 205 230

(51) Int. Cl.
*H04R 7/18* (2006.01)
*H04R 1/02* (2006.01)
(Continued)

(52) U.S. Cl.
CPC ..... *H04R 7/18* (2013.01); *H04R 1/021* (2013.01); *H04R 1/08* (2013.01); *H04R 7/16* (2013.01); *H04R 7/20* (2013.01); *H04R 31/003* (2013.01)

(58) Field of Classification Search
CPC ..... H04R 1/222; H04R 1/021; H04R 7/18; H04R 7/20; H04R 7/22
(Continued)

(56) References Cited

U.S. PATENT DOCUMENTS 3,603,427 A 9/1971 Sotome et al.
5,673,330 A 9/1997 Chang
(Continued)

FOREIGN PATENT DOCUMENTS

DE 298 05 510 8/1998
DE 60 2004 002 008 2/2007
(Continued)

OTHER PUBLICATIONS

International Search Report (PCT/EP2013/056363) dated May 27, 2013.

*Primary Examiner* — Jesse A Elbin
(74) *Attorney, Agent, or Firm* — Haug Partners LLP

(57) ABSTRACT

A microphone having a microphone capsule is provided. The microphone capsule has a diaphragm carrier, a diaphragm and an adhesive tape ring which is used to fasten the diaphragm to or in the diaphragm carrier. The microphone capsule is in the form of a dynamic sound transducer. A dynamic sound transducer for headphones, earphones or headsets is also provided. The sound transducer has a diaphragm carrier, a diaphragm and a moving coil which is coupled to the diaphragm. In a similar manner to the microphone capsule, the sound transducer has an adhesive tape ring between the diaphragm and the diaphragm carrier, which ring is used to fasten the diaphragm to the diaphragm carrier.

10 Claims, 8 Drawing Sheets

(51) Int. Cl.

| | |
|---|---|
| ***H04R 7/20*** | (2006.01) |
| ***H04R 31/00*** | (2006.01) |
| ***H04R 1/08*** | (2006.01) |
| ***H04R 7/16*** | (2006.01) |

(58) Field of Classification Search
USPC ..... 381/369, 177, 398; 181/171, 172
See application file for complete search history.

(56) References Cited

U.S. PATENT DOCUMENTS

| | | | | |
|---|---|---|---|---|
| 6,229,114 | B1 * | 5/2001 | Andrews | B41J 2/14 219/121.71 |
| 8,041,070 | B2 * | 10/2011 | Kamimura | H04R 9/10 381/398 |
| 2002/0176597 | A1 | 11/2002 | Petroff et al. | |
| 2003/0215109 | A1 * | 11/2003 | Kosuda | H04R 9/06 381/412 |
| 2007/0274543 | A1 * | 11/2007 | Ueda | H04R 7/12 381/162 |

FOREIGN PATENT DOCUMENTS

| | | |
|---|---|---|
| EP | 0 296 139 | 12/1988 |
| FR | 2 542 551 | 9/1984 |
| JP | 2000/197187 | 7/2000 |

* cited by examiner

MICROPHONE HAVING A MICROPHONE CAPSULE, DYNAMIC SOUND TRANSDUCER FOR HEADPHONES, EARPHONES OR HEADSETS AND METHOD FOR PRODUCING A MICROPHONE CAPSULE OR A SOUND TRANSDUCER

The present application claims priority from PCT Patent Application No. PCT/EP2013/056363 filed on Mar. 26, 2013, which claims priority to German Patent Application No. DE 10 2012 205 230.5 filed on Mar. 30, 2012, the disclosures of which are incorporated herein by reference in their entirety.

FIELD OF THE INVENTION

The present invention concerns a microphone having a microphone capsule and a dynamic sound transducer for headphones, earphones or headsets and a method for producing a microphone capsule or a sound transducer.

It is noted that citation or identification of any document in this application is not an admission that such document is available as prior art to the present invention.

A microphone capsule typically has a diaphragm carrier on which a diaphragm is fixed. Typically the diaphragm is fixed to the diaphragm carrier with a wet adhesive. When applying a wet adhesive to the diaphragm carrier or to the diaphragm it is very difficult to reproducibly provide the required amount and the required distribution of the adhesive. When the diaphragm is then placed on the diaphragm carrier or the ring of wet adhesive that can then involve displacement of the adhesive into the corrugation region of the diaphragm. After the wet adhesive has set that can result in irregular stiffening of the diaphragm in the corrugation region. That is detrimental as that causes an increased susceptibility to wobble on the part of the transducer.

The following documents were searched in the German patent application from which priority is claimed: DE 29 805 510 U1, DE 60 2004 002 088 T2, US 2002/0176597 A1; 3M Industrial Business, Converter Markets, Industrial Adhesives and Tapes Division, USA; VHB™ Adhesive Transfer Tapes with Adhesive 100MP F9460 PC F9469 PC F9473PC—company publication.

It is noted that in this disclosure and particularly in the claims and/or paragraphs, terms such as "comprises", "comprised", "comprising" and the like can have the meaning attributed to it in U.S. Patent law; e.g., they can mean "includes", "included", "including", and the like; and that terms such as "consisting essentially of" and "consists essentially of" have the meaning ascribed to them in U.S. Patent law, e.g., they allow for elements not explicitly recited, but exclude elements that are found in the prior art or that affect a basic or novel characteristic of the invention.

It is further noted that the invention does not intend to encompass within the scope of the invention any previously disclosed product, process of making the product or method of using the product, which meets the written description and enablement requirements of the USPTO (35 U.S.C. 112), such that applicant(s) reserve the right to disclaim, and hereby disclose a disclaimer of, any previously described product, method of making the product, or process of using the product.

SUMMARY OF THE INVENTION

Therefore an object of the present invention is to provide a microphone having a microphone capsule and a corresponding method for producing the microphone capsule, which ensures uniform stiffening of a corrugation region of the diaphragm even in mass production.

Thus there is provided a microphone having a microphone capsule. The microphone capsule has a diaphragm carrier, a diaphragm and an adhesive tape ring which is used to fix the diaphragm on or in the diaphragm carrier. The microphone capsule is in the form of a dynamic sound transducer.

The use of a ring comprising adhesive tape makes it possible to achieve a higher level of precision in processing the microphone capsule. Such precision in processing is not possible with a fluid adhesive because a fluid adhesive always runs.

According to an aspect of the present invention the adhesive tape ring can be of a double-sided or single-sided adhesive nature. The adhesive tape ring can also have a carrier layer.

According to an aspect of the present invention the diaphragm carrier has an annular diaphragm support on which the adhesive tape ring is placed. An outer portion of the diaphragm is then fixed on the adhesive tape ring.

The increased degree of precision in processing with the microphone according to the invention means that it is possible to produce in particular sound transducers of a smaller diameter, that is to say of a diaphragm diameter of ≤80 mm. The advantage of the increased precision is apparent in particular in relation to transducers with a diaphragm diameter of ≤40 mm.

According to an aspect of the present invention the adhesive ring can be of a width of ≤1 mm in the radial direction. That is possible only due to the increased precision in processing as a ring comprising an adhesive tape instead of a fluid adhesive is used.

According to an aspect of the present invention the adhesive tape ring forms a closed contour. This makes it possible to prevent air from inadvertently passing through transitional locations between a plurality of portions of adhesive tapes. In addition the use of just a single piece (that is to say the adhesive tape ring) in assembly represents a considerable advantage. In that respect only one piece has to be placed instead of positioning a plurality of adhesive pieces relative to each other.

According to an aspect of the present invention the diaphragm is of a round configuration as this permits more uniform distribution of force in the diaphragm and thus a low-distortion transducer.

The invention also concerns a method for producing a microphone capsule having a diaphragm carrier and a diaphragm. An adhesive tape ring is cut out of an adhesive tape by means of laser cutting. The ring is placed on or in the diaphragm carrier and the diaphragm is placed on the adhesive tape ring.

According to an aspect of the present invention a vacuum stamp is placed on a first side of the adhesive tape and the laser is placed on the second side of the adhesive tape.

According to a further aspect of the present invention an adhesive region of the adhesive tape ring is freed with the laser and the outer region of the adhesive tape ring is cut out with the laser.

The invention also concerns a dynamic sound transducer for headphones, earphones or headsets. The sound transducer has a diaphragm carrier, a diaphragm, a moving coil coupled to the diaphragm and an adhesive tape ring which is provided between the diaphragm and the diaphragm carrier for fixing the diaphragm to the diaphragm carrier. The adhesive tape ring of the dynamic sound transducer can be of a configuration like the adhesive tape ring of the above-described microphone.

The invention concerns the notion of using an adhesive tape film ring (for example a double-sided adhesive tape), instead of a wet adhesive, for fixing the diaphragm on the diaphragm carrier. That is advantageous in particular because that makes it possible to ensure that the adhesive is of a uniform thickness in the form of an adhesive tape film.

According to the invention the required adhesive tape film ring can be cut out of an adhesive tape strip by means of a laser.

The defined adhesive tape film makes it possible to achieve more uniform adhesion of the diaphragm to the diaphragm carrier. Furthermore it is possible to enable the diaphragm to be mounted at the entire diaphragm periphery on the diaphragm carrier in a condition of being free from inherent stress. According to the invention an adhesive tape ring can be produced for example from a double-sided adhesive tape or from a single-sided adhesive tape, in which case the adhesive tape film ring is placed together with a carrier film on the diaphragm carrier. The carrier film can then be removed and the adhesive tape film ring remains on the diaphragm carrier. The diaphragm can then be fitted and pressed in place.

With the microphone capsule according to the invention, the method according to the invention for producing the microphone capsule and the dynamic sound transducer, it is possible to provide a defined adhesive material or adhesive tape surface on the diaphragm support. That also makes it possible to achieve appropriate separation of the fixed region of the diaphragm which remains on the adhesive tape film ring, and the flexible or moving region of the diaphragm. The corrugation of the diaphragm is no longer only partially stiffened (for example due to a creeping wet adhesive). The thickness of the adhesive ring can be precisely determined and selected by the choice of the thickness of the adhesive tapes used for producing the adhesive tape ring. The damping properties of the diaphragm mounting connection can be influenced by the choice of the thickness of the adhesive tape. An increasing thickness of the adhesive tape layer proportionately increases the softness of the diaphragm in the radial direction. That is advantageous because the sound transducer or the microphone capsule is accordingly less susceptible to partial natural oscillations.

According to the invention the microphone is in the form of a dynamic sound transducer.

DETAILED DESCRIPTION OF EMBODIMENTS

It is to be understood that the figures and descriptions of the present invention have been simplified to illustrate elements that are relevant for a clear understanding of the present invention, while eliminating, for purposes of clarity, many other elements which are conventional in this art. Those of ordinary skill in the art will recognize that other elements are desirable for implementing the present invention. However, because such elements are well known in the art, and because they do not facilitate a better understanding of the present invention, a discussion of such elements is not provided herein.

The present invention will now be described in detail on the basis of exemplary embodiments.

Figure 1A:
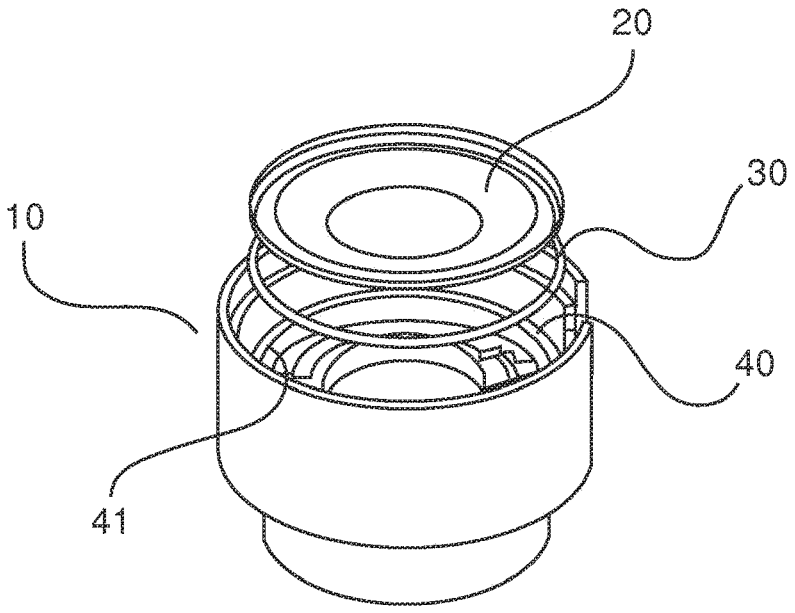
FIGS. 1A and 1B show perspective views of a microphone capsule according to a first embodiment.
Figure 1B:
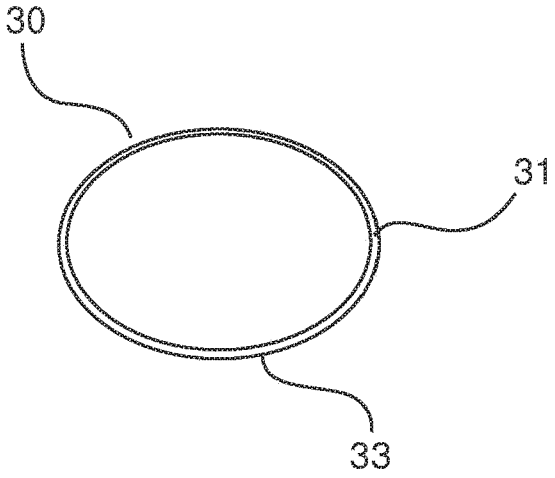

FIGS. 1A and 1B show a perspective view of a microphone capsule according to a first embodiment. FIG. 1A shows a perspective view of a microphone capsule according to the first embodiment. The microphone capsule 10 has a diaphragm carrier 40, an adhesive tape (film) ring 30 and a diaphragm 20. The diaphragm 20 is mounted on or in the diaphragm carrier 40 by means of the adhesive tape film ring 30. In particular the adhesive tape film ring 30 is placed on a diaphragm support 41 and the diaphragm 20 is then fitted on to the adhesive tape film ring 30.

FIG. 1B shows the adhesive tape film ring 30. The adhesive tape film ring is produced from an adhesive tape and can have a freed region (adhesive region) 31 and a carrier material 33. The adhesive tape film ring 30 is of a radial width of ≤1 mm. The diaphragm 20 according to the first embodiment is of a diameter of ≤80 mm and in particular ≤40 mm. As shown in FIG. 1B the adhesive tape film ring 30 is of a closed contour. The outside diameter of the adhesive tape film ring is ≤80 mm and in particular ≤40 mm.

Figure 2A:
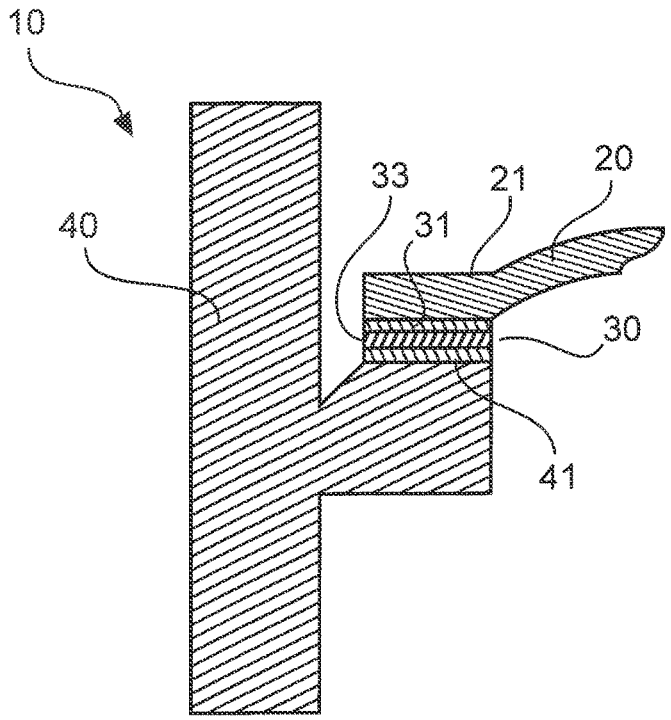
FIGS. 2A and 2B each show a diagrammatic sectional view of a microphone capsule according to a second embodiment.
Figure 2B:
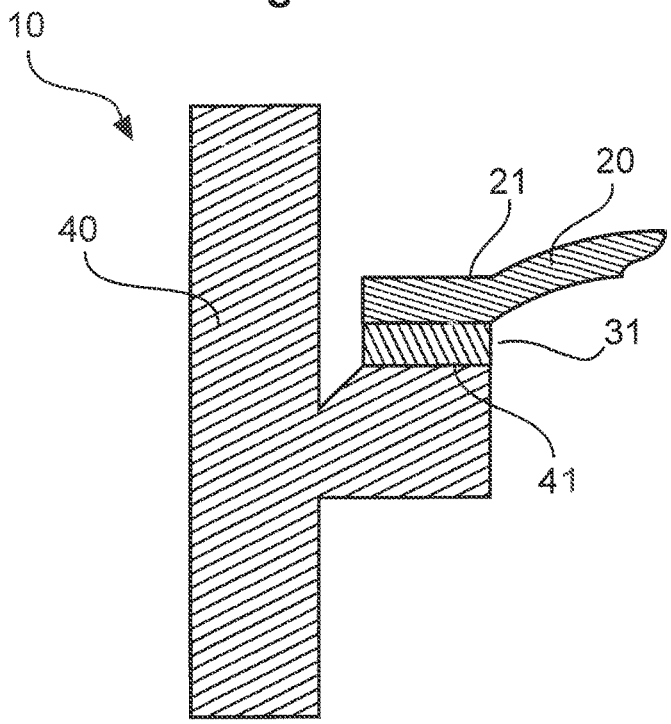

FIGS. 2A and 2B each show a diagrammatic sectional view of a microphone capsule according to a second embodiment. FIGS. 2A and 2B each show a diagrammatic sectional view of a part of a microphone capsule according to a second embodiment. The microphone capsule according to the second embodiment can be based on the microphone capsule of the first embodiment. The microphone capsule has a diaphragm carrier 40 with a diaphragm support 41, an adhesive tape film ring 30 and a diaphragm 20. The adhesive tape film ring 30 is preferably placed on the diaphragm support 41. The diaphragm 20 has for example an outer region 21 which is placed on the adhesive tape film ring 30.

In an embodiment as shown in FIG. 2A the adhesive tape 30 has a carrier layer 33 in the adhesive tape film. In the FIG. 2B embodiment the adhesive tape does not have a carrier layer.

Figure 3:
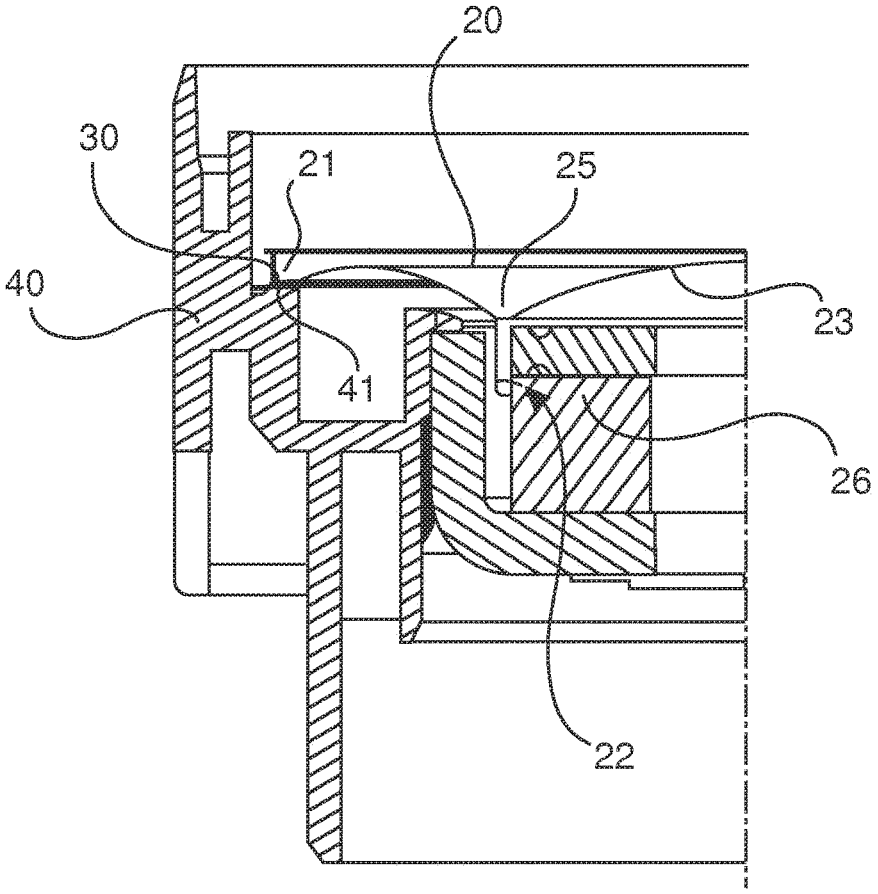
FIG. 3 shows a diagrammatic sectional view of a microphone capsule according to a third embodiment.

FIG. 3 shows a diagrammatic sectional view of a microphone capsule according to a third embodiment. The microphone capsule of the third embodiment can be based on or derived from a microphone capsule according to the first or second embodiment. The microphone capsule is designed for a dynamic sound transducer. The microphone capsule has a diaphragm carrier 40 having an inwardly disposed diaphragm support 41, a diaphragm 20 and an adhesive tape film ring 30 which is placed on the diaphragm support 41 and serves for fixing the diaphragm 20. In particular an outer region 21 of the diaphragm is fixed or glued to the adhesive tape film ring 30. The diaphragm typically has a corrugation 25 and a central portion 23. A moving coil 22 which co-operates with a solenoid system 26 of the transducer can be provided in the region of the corrugation 25.

According to the invention the adhesive tape film ring 30 is produced from an adhesive tape, that is to say an adhesive which is not fluid and which does not creep. Optionally the adhesive tape can be of a double-sided adhesive nature.

The microphone or the microphone capsule according to the first, second or third embodiment is a microphone capsule which is in the form of a dynamic sound transducer.

Figure 4A:
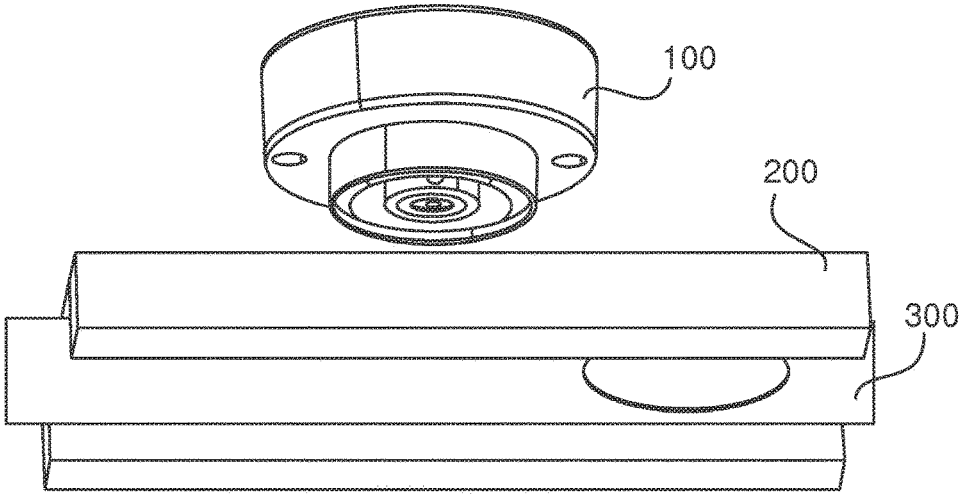
FIGS. 4A through 4L each show a perspective view in a method for producing a microphone capsule according to a fourth embodiment.

FIGS. 4A through 4L each show a perspective view in a method for producing a microphone capsule according to a fourth embodiment. A microphone capsule according to the first, second or third embodiment can be produced with the method for producing a microphone capsule according to the fourth embodiment. FIG. 4A shows a vacuum stamp 100, a guide 200 and an adhesive tape 300.

Figure 4B:
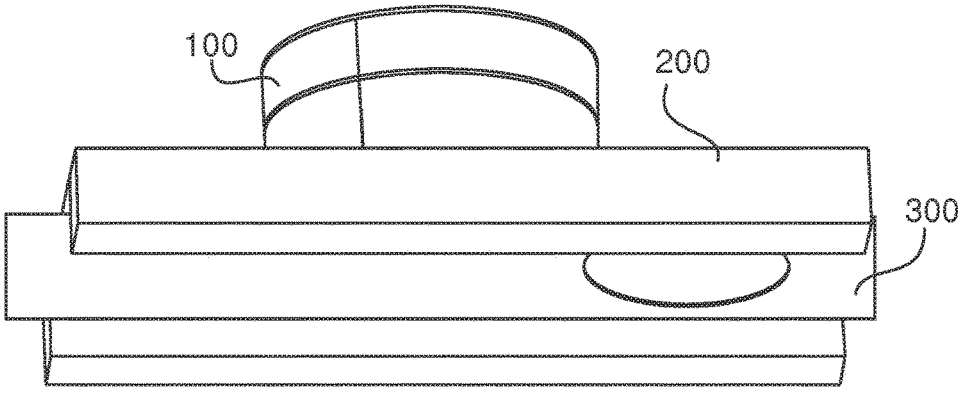
Figure 4C:
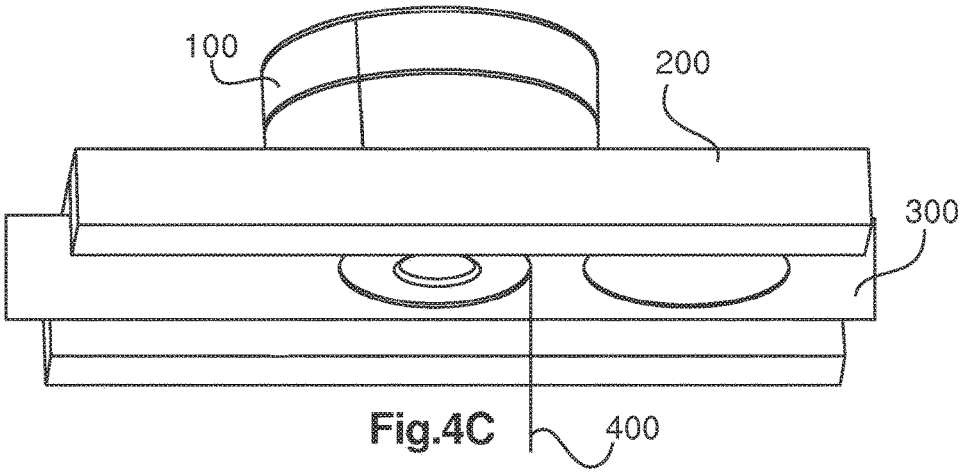
Figure 4D:
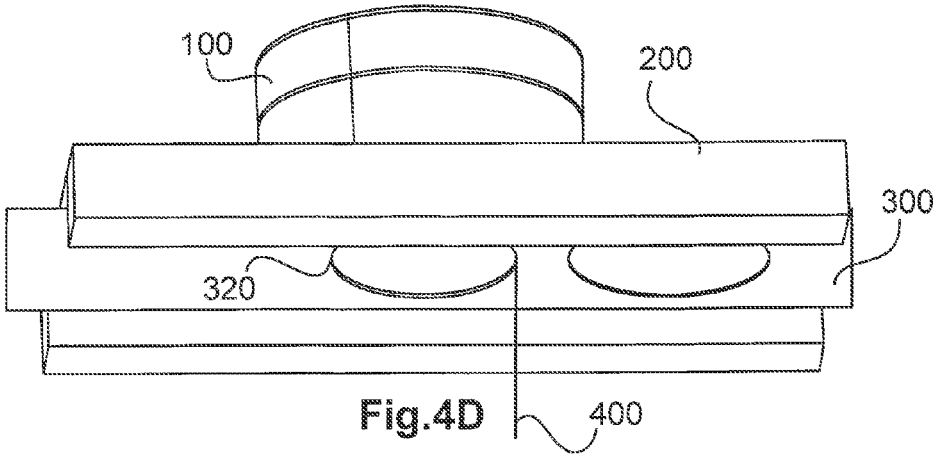
Figure 4E:
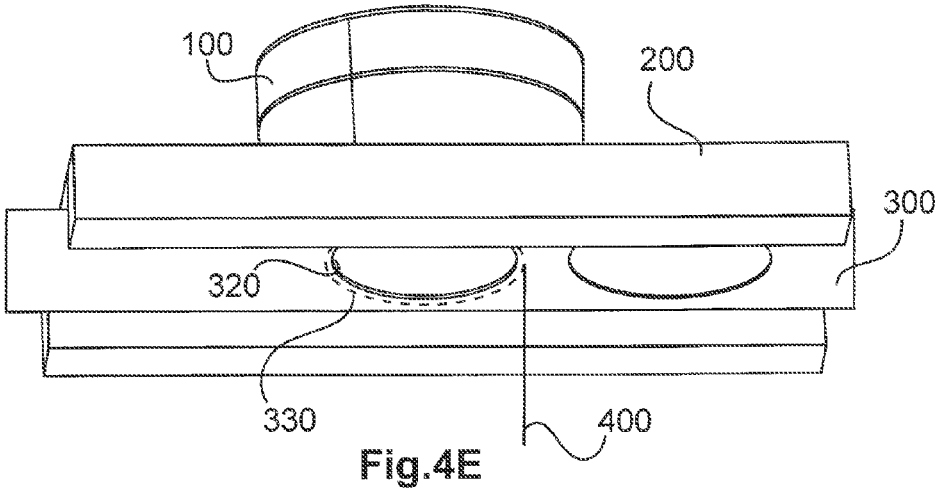
Figure 4F:
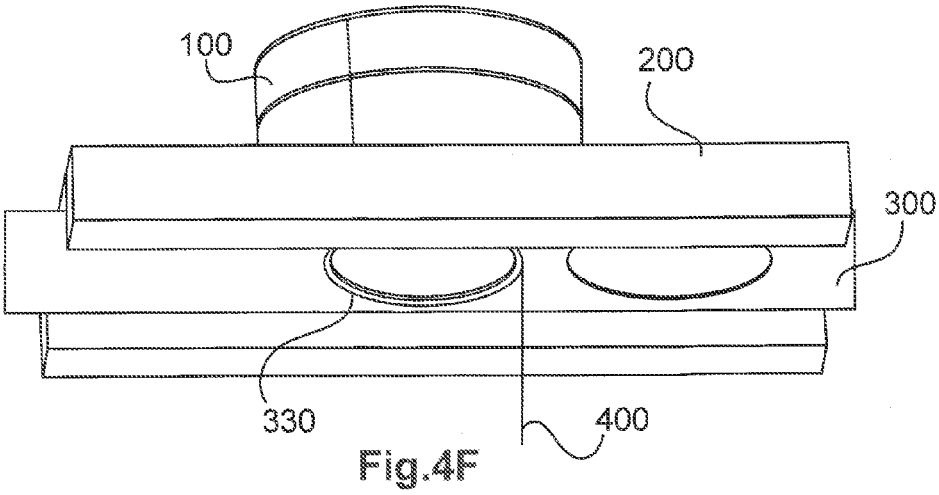
Figure 4G:
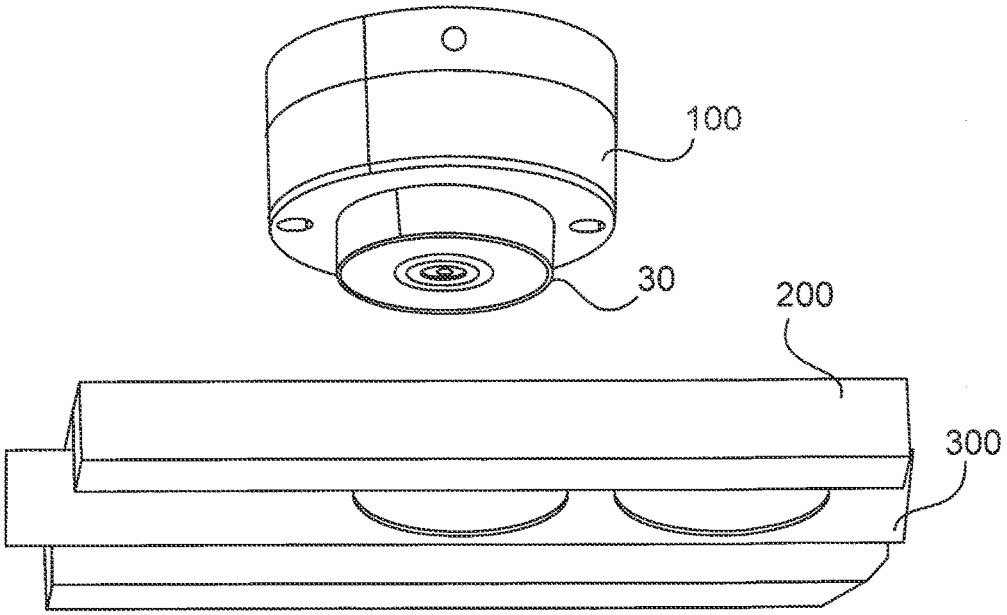
Figure 4H:
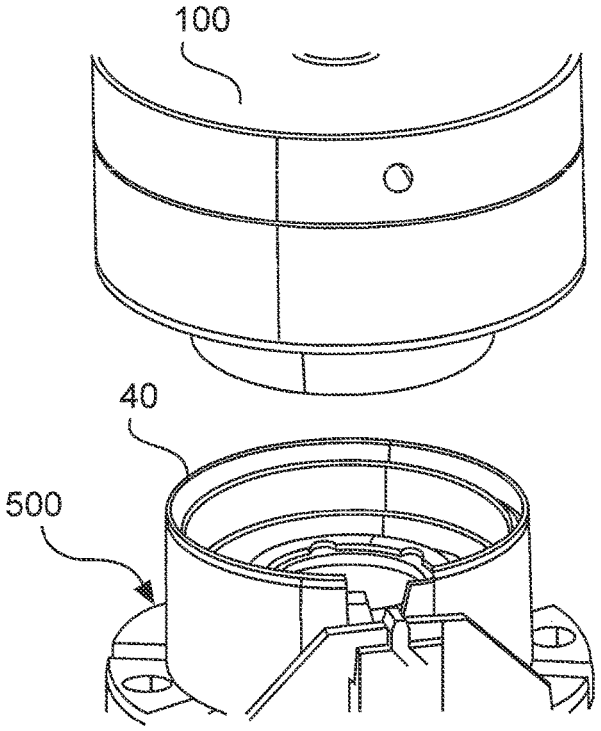
Figure 4I:
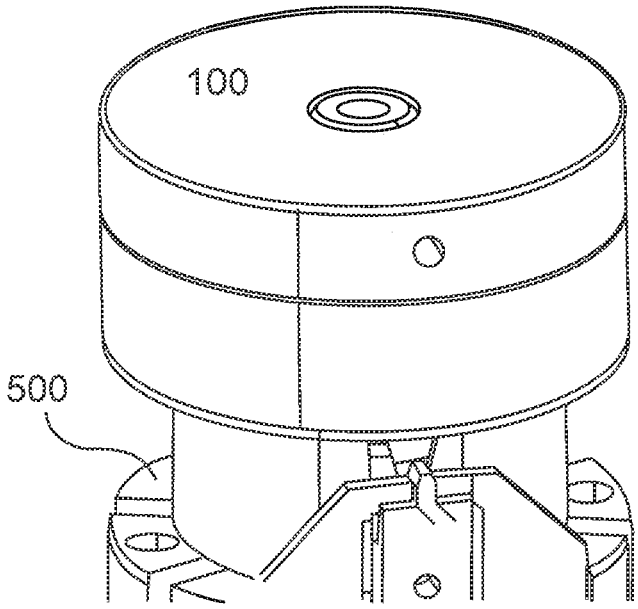
Figure 4J:
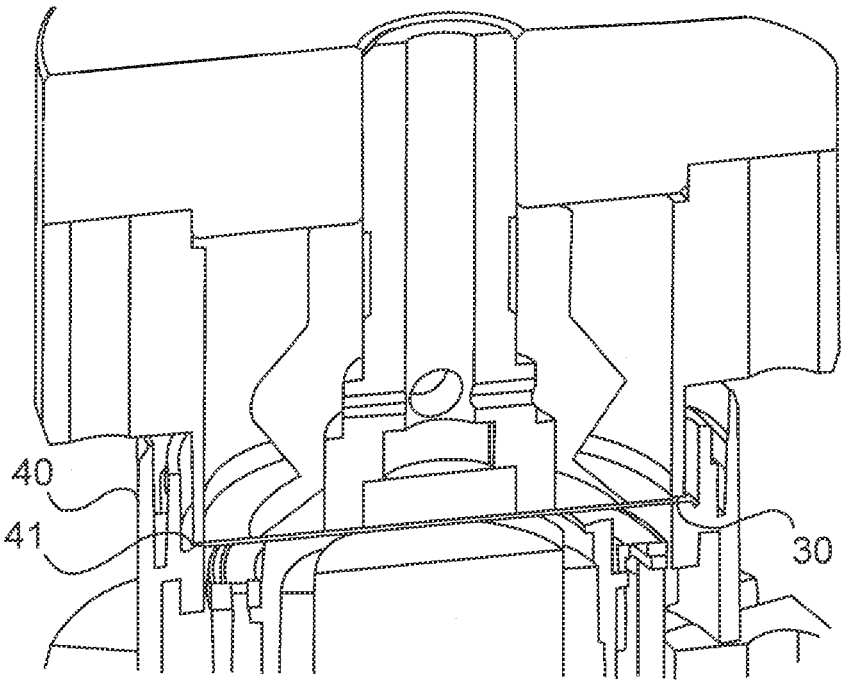
Figure 4K:
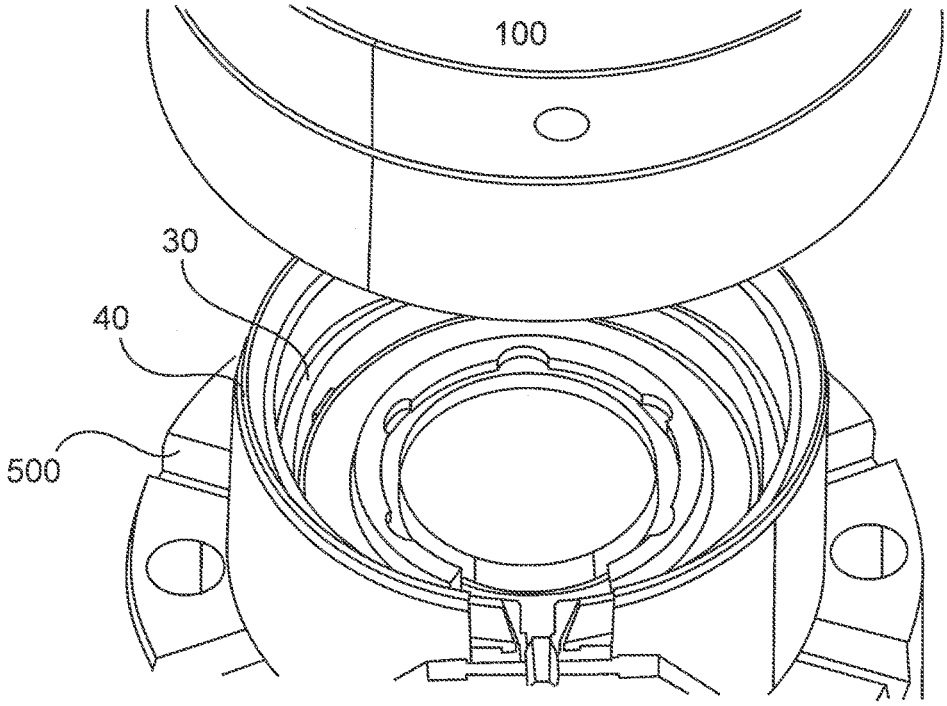
Figure 4L:
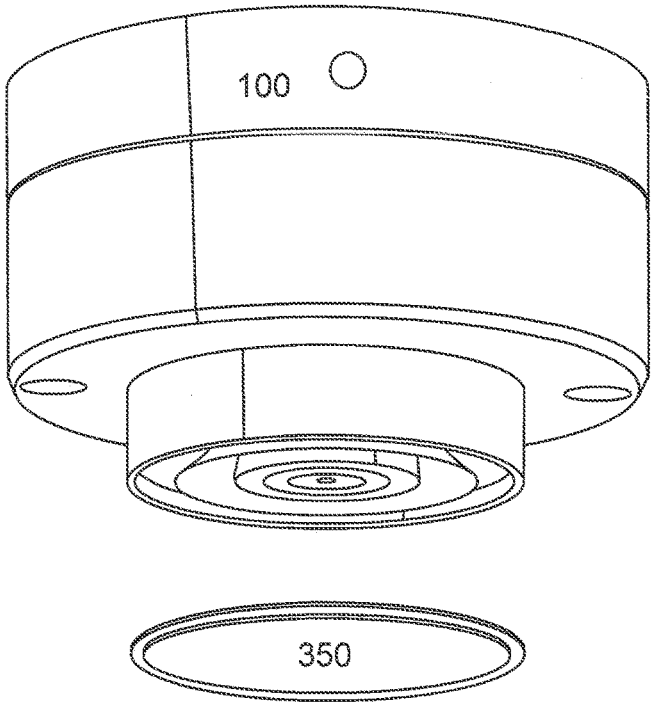

In FIG. 4B the vacuum stamp is applied to a side of the adhesive tape 300. A laser 400 is activated in FIG. 4C. In FIG. 4D an annular portion 320 of the adhesive tape 300 is freed or exposed. In FIG. 4F a ring 330 is cut out by the laser 400. In that operation the laser 400 cuts through the complete adhesive tape 300. In FIG. 4G the vacuum stamp is removed from the adhesive tape so that the adhesive tape ring 30 remains on the vacuum stamp. In FIG. 4H the vacuum stamp 100 (with the adhesive tape ring 30) moves into a diaphragm holder 40 which is fixed on a holder 500. In FIG. 4I the adhesive tape ring is placed on the diaphragm support. FIG. 4J shows a diagrammatic sectional view through FIG. 4I. In FIG. 4K the vacuum stamp is then removed while the adhesive tape ring 30 remains on the diaphragm support 41. In FIG. 4L the residue 350 of the adhesive tape can then be disposed of.

The microphone capsule produced in accordance with the third embodiment has a diaphragm of a diameter of ≤80 mm and in particular a diameter of ≤40 mm. That means that the outside diameter of the adhesive tape ring 30 is also ≤80 mm and in particular ≤40 mm. The width of the adhesive tape ring 30 is ≤1 mm. The adhesive tape ring 30 is of a closed contour.

According to a fourth embodiment a dynamic sound transducer is provided for headphones, earphones or headsets. The sound transducer has a diaphragm carrier 40, a diaphragm 20, a moving coil 22 and an adhesive tape ring 30. The configuration of the diaphragm carrier 40, the diaphragm 20, the moving coil 22 and the adhesive tape ring 30 according to the fourth embodiment can correspond to the configuration of the diaphragm carrier 40, the diaphragm 20, the moving coil 22 and the adhesive tape ring 30 according to the first, second or third embodiment.

According to a further embodiment of the invention there is provided an electroacoustic dynamic sound transducer having a diaphragm carrier 40, a diaphragm 20, a moving coil 22 coupled to the diaphragm 20, and an adhesive tape ring 30 between the diaphragm 20 and the diaphragm carrier 40 for fixing the diaphragm 20 to the diaphragm carrier 40. That electroacoustic dynamic sound transducer can optionally serve or be used in a microphone or in a sound transducer for earphones or headphones, but not as a sound transducer for loudspeakers.

According to the invention a dynamic sound transducer is a sound transducer which has a diaphragm with a moving coil coupled thereto, the moving coil moving in a magnetic field of a solenoid system.

According to the invention the diameter of the diaphragm is ≤5 cm.

While this invention has been described in conjunction with the specific embodiments outlined above, it is evident that many alternatives, modifications, and variations will be apparent to those skilled in the art. Accordingly, the preferred embodiments of the invention as set forth above are intended to be illustrative, not limiting. Various changes may be made without departing from the spirit and scope of the inventions as defined in the following claims.

The invention claimed is:

1. A microphone comprising:

a microphone capsule which has:

a diaphragm carrier;

a diaphragm; and an adhesive tape ring;

wherein the adhesive tape ring glues or fixes the diaphragm to the diaphragm carrier;

wherein the microphone capsule is in the form of a dynamic sound transducer;

wherein the diaphragm carrier has an annular diaphragm support on which the adhesive tape ring is placed;

wherein the diaphragm has an annular outer portion which is placed on the adhesive tape ring;

wherein a diameter of the diaphragm is ≤80 mm;

wherein the adhesive tape ring has a width of ≤1 mm in a radial direction; and wherein the adhesive tape ring has a closed contour.

2. The microphone as set forth in claim 1;

wherein the adhesive tape ring has a carrier layer.

3. The microphone as set forth in claim 1;

wherein the adhesive tape ring is of a double-sided adhesive nature.

4. The microphone as set forth in claim 1;

wherein the diameter of the diaphragm is ≤40 mm.

5. The microphone as set forth in claim 1;

wherein the diaphragm is round.

6. A method for producing a microphone capsule or a dynamic sound transducer having a diaphragm carrier which has an annular diaphragm support, and having a diaphragm which has an annular outer portion, the method comprising the steps:

laser cutting an adhesive tape ring from an adhesive tape;

placing the cut-out adhesive tape ring on the annular diaphragm support of the diaphragm carrier; and fitting the annular outer portion of the diaphragm on to the adhesive tape ring;

wherein the diameter of the diaphragm is ≤80 mm;

wherein a width of the adhesive tape ring in a radial direction is ≤1 mm; and wherein the adhesive tape has a closed contour.

7. The method as set forth in claim 6, further comprising the steps:

applying a vacuum stamp on a first side of the adhesive tape; and cutting a ring out of the adhesive tape by a laser from the second side of the adhesive tape.

8. The method as set forth in claim 6, further comprising the steps:

freeing an adhesive portion of the adhesive tape ring by the laser; and cutting out the outer contour of the adhesive tape ring by means of the laser.

9. A dynamic sound transducer for headphones, earphones, or headsets, comprising:

a diaphragm carrier having an annular diaphragm support;

a diaphragm having an annular outer portion;

a moving coil coupled to the diaphragm; and an adhesive tape ring between the annular outer portion of the diaphragm and the annular diaphragm support of the diaphragm carrier which fixes the diaphragm to the diaphragm carrier;

wherein a diameter of the diaphragm is ≤80 mm;

wherein the adhesive tape ring has a width of ≤1 mm in a radial direction; and wherein the adhesive tape ring has a closed contour.

10. The dynamic sound transducer as set forth in claim 9:

wherein the diameter of the diaphragm is ≤40 mm.

* * * * *